US005482022A

United States Patent [19]

Aoki et al.

[11] Patent Number: 5,482,022

[45] Date of Patent: Jan. 9, 1996

[54] FUEL INJECTION SYSTEM FOR INTERNAL COMBUSTION ENGINE

[75] Inventors: Narutoshi Aoki, Mishima; Tsuneaki Endou; Mitsugi Koike, both of Numazu, all of Japan

[73] Assignee: Kokusan Denki Co., Ltd., Shizuoka, Japan

[21] Appl. No.: 263,080

[22] Filed: Jun. 21, 1994

[51] Int. Cl.[6] ..... F02D 41/06

[52] U.S. Cl. ..... 123/479; 123/480; 123/491

[58] Field of Search ..... 123/491, 480, 123/479, 436

[56] References Cited

U.S. PATENT DOCUMENTS

| | | | |
|---|---|---|---|
| 4,261,314 | 4/1981 | Graessley | 123/480 |
| 4,723,523 | 2/1988 | Kataoka et al. | 123/491 |
| 5,161,496 | 11/1992 | Matsushima et al. | 123/185.3 |
| 5,216,994 | 6/1993 | Aoki et al. | 123/490 |

FOREIGN PATENT DOCUMENTS 2-221660 9/1990 Japan .

4-41947 2/1992 Japan .

*Primary Examiner*—Andrew M. Dolinar

*Attorney, Agent, or Firm*—Pearne, Gordon, McCoy & Granger

[57] ABSTRACT

A fuel injection system wherein a microcomputer carries out an operation of a fuel injection period using a generator mounted on an internal combustion engine as a power supply is provided, which is capable of preventing excessive feeding of fuel to the engine during restarting of the engine to ensure smooth restarting of the engine. The fuel injection system includes a charge storing circuit for carrying out charging of a charge storage element during initial starting of the engine, a discharge circuit for permitting discharge of the charge storage element to be carried out over a long period of time, and a signal generating circuit for generating an initial starting signal when the amount of charges in the charge storage element is below a predetermined level and a restarting signal when the amount reaches the predetermined level or more. Where the restarting signal has been generated at the time when the microcomputer starts to operate, it executes an operation of a fuel injection period which provides a fuel injection rate suitable for the restarting.

11 Claims, 6 Drawing Sheets

FIG. 2
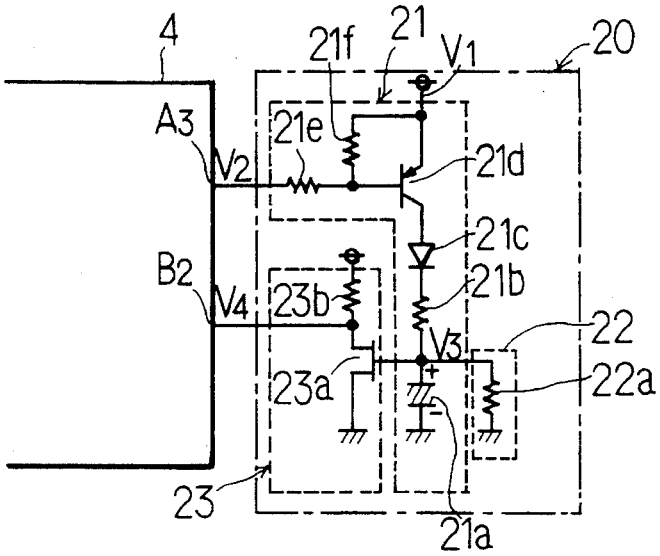
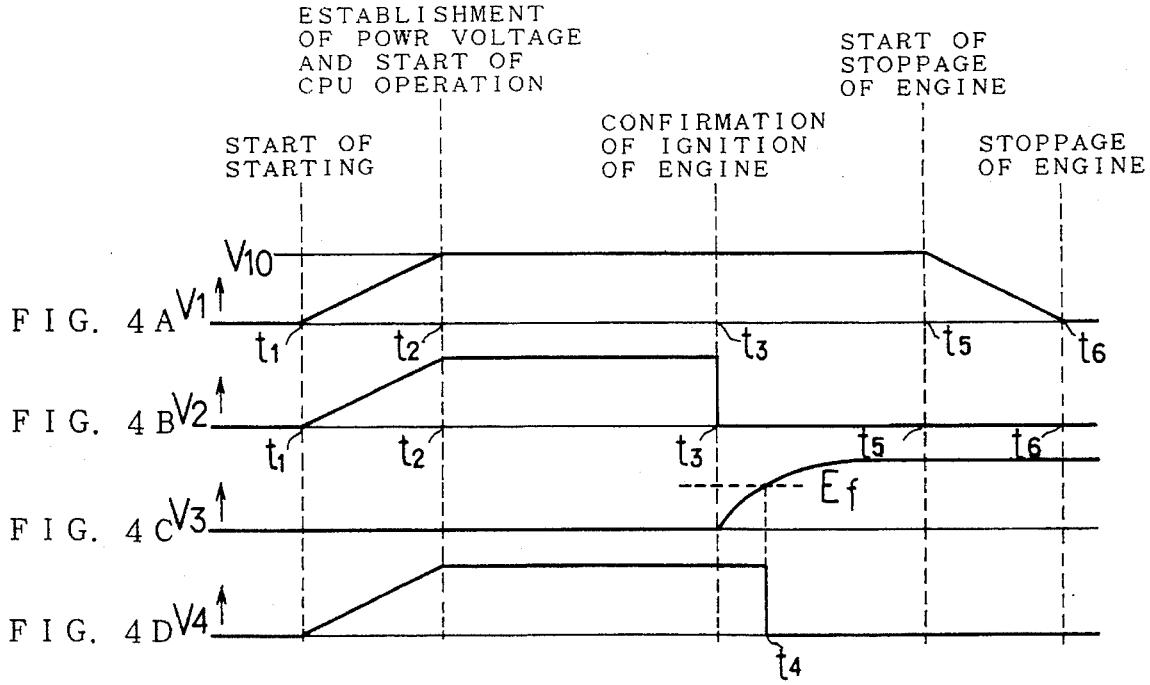

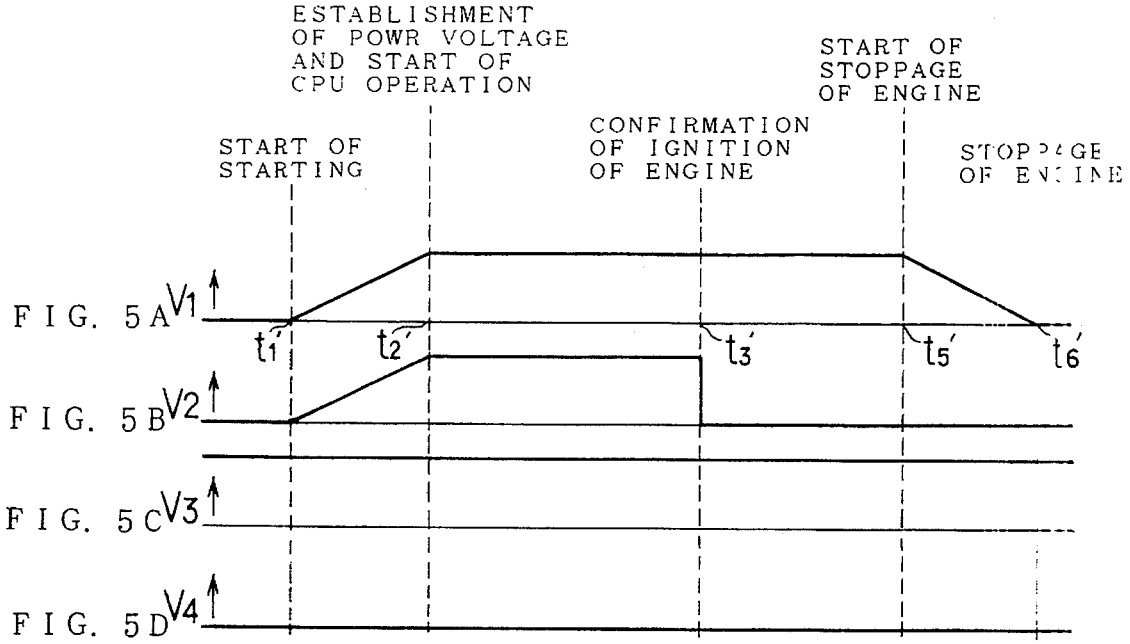
FIG. 6
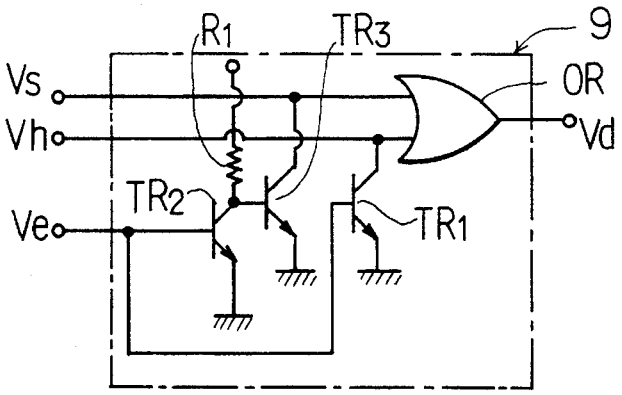

FUEL INJECTION SYSTEM FOR INTERNAL COMBUSTION ENGINE

BACKGROUND OF THE INVENTION

This invention relates to a fuel injection system for an internal combustion engine, and more particularly a fuel injection system for feeding an internal combustion engine with fuel.

In order that an operation of an internal combustion is carried out while being kept optimum, it is essential to properly control an air-fuel ratio depending on a temperature at each of sections of the engine, an engine rotation speed and the like. A rate of injection of fuel fed to the engine by means of a fuel injector is determined depending on a fuel injection period or a period of time during which fuel is ejected from the injector and a pressure of fuel applied to the injector. The air-fuel ratio is affected by an ambient temperature and an atmospheric pressure, therefore, appropriate control of the air-fuel ratio requires to accurately control the fuel injection period based on control conditions such as an atmospheric pressure, a temperature of each of the sections of the engine, and the like.

For this purpose, a fuel injection system for an internal combustion engine is proposed which is constructed so as to control feed of a driving current to a fuel injector depending on an atmospheric pressure, an ambient temperature, a temperature of each of sections of the engine, an engine rotation speed, a degree of opening of a throttle and the like by means of a microcomputer, to thereby control a fuel injection period.

In the fuel injection system thus constructed, the microcomputer functions to carry out an operation of the fuel injection period suitable for starting of the engine at the time of starting of the engine. Upon completion of starting of the engine, the microcomputer carries out an operation of a fuel injection position or a rotation angle position at which fuel injection is started and the fuel injection period based on information on an atmospheric pressure, an ambient temperature and the like input thereto from a sensor and an output of a signal generator fed thereto, to thereby generate an injection command signal containing information on the fuel injection period obtained by the operation at the fuel injection position obtained by the operation. The injection command signal comprises, for example, a signal of a rectangular waveform rising at the fuel injection position and having a signal width equal to the fuel injection period. The injection command signal is then fed to an injector drive circuit, which then feeds the fuel injector with a driving current for a period of time during which the injection command signal is kept fed thereto. Thus, the injector keeps a valve provided therein open during feeding of the drive signal thereto, leading to injection of fuel.

When the internal combustion engine which has been subject to initial starting as described above is then temporarily stopped, followed by restarting, feeding of fuel to the engine at the same air-fuel ratio as in the initial starting causes the amount of fuel fed during the restarting to be excessive to a degree sufficient to cover an ignition plug, leading to a failure in restating of the engine. The term "initial starting" used herein indicates starting of an engine carried out after it is stopped for a long length of time and the term "restarting" referred to herein means starting of an engine carried out immediately or in a short period of time after it is temporarily stopped.

The above-described problem is solved by reducing a fuel feed rate at restarting of the engine. For this purpose, an fuel injection system for an internal combustion engine including a battery acting as a control power supply is proposed which is constructed so as to control changing-over of a fuel injection rate between initial starting of the engine and restarting thereof, as disclosed in, for example, Japanese Patent Application Laid-Open Publication No. 41947/1992. A fuel injection system disclosed in the Japanese publication is adapted to obtain a residue of fuel in the engine when it is stopped by operation, so that a fuel injection rate at restarting of the engine is determined in view of the fuel residue obtained. Also, Japanese Patent Application Laid-Open Publication No. 221660/1990 discloses a fuel injection system for a two-cycle engine mounted thereon with a battery and started by means of a kick starter. The fuel injection system disclosed is adapted to reduce a fuel injection rate at restarting of the engine when the kick starter is operated. More specifically, the fuel injection system is constructed so as to count the number of times of kick operation of the kick starter, to thereby reduce a fuel injection rate in correspondence to an increase in counted value.

On the contrary, a conventional fuel injection system directed to an internal combustion engine free of a battery as disclosed in U.S. Pat. Nos. 5,216,994 and 5,161,496 is not constructed so as to carry out control for changing-over of a fuel injection rate between initial starting of the engine and restarting thereof. This is for the reason that when a microcomputer is operated using a generator driven by the engine as a power supply therefor, it starts a predetermined operation after a voltage of the generator is established; so that it fails to judge whether starting of the engine is initial starting of the engine or restarting thereof. Thus, the conventional fuel injection system in which the microcomputer is operated using the generator driven by the engine as a power supply therefor causes a fuel injection rate at the initial starting to be identical with that at the restarting, resulting in starting characteristics of the engine at the restarting to be significantly deteriorated.

SUMMARY OF THE INVENTION

The present invention has been made in view of the foregoing disadvantage of the prior art.

Accordingly, it is an object of the present invention to provide a fuel injection system for an internal combustion engine which is capable of accomplishing smooth restarting of the engine while operating a microcomputer using a generator driven by the engine as a power supply therefor.

It is another object of the present invention to provide a fuel injection system for an internal combustion engine which is capable of setting an optimum fuel injection rate at the time of restarting of the engine while operating a microcomputer using a generator driven by the engine as a power supply therefor.

It is a further object of the present invention to provide a fuel injection system for an internal combustion engine which is capable of ensuring positive restarting of the engine after a failure in ignition of the engine while preventing a reduction in fuel injection rate.

It is still another object of the present invention to provide a fuel injection system for an internal combustion engine which is capable of ensuring starting and continuing of the engine even when a failure in operation of a microcomputer or any operational abnormality thereof occurs.

In accordance with the present invention, a fuel injection system for an internal combustion engine is provided. The fuel injection system includes a generator driven by the internal combustion engine, a fuel injector for ejecting fuel when it is fed with a driving current while using the generator as a power supply therefor, and an initial starting/restarting detecting circuit including a charge storage element charged by means of an output of the generator and discharging charges stored therein during stoppage of the internal combustion engine while starting of the internal combustion engine is carried out.

The initial starting/restarting detecting circuit detects depending on the amount of charges stored in the charge storage element whether starting of the internal combustion engine is initial starting or restarting while starting of the internal combustion engine is carried out. The fuel injection system also includes a microcomputer for generating an injection command signal containing information on a fuel injection period. The microcomputer operates while using the generator as a power supply therefor and carries out, during starting of the internal combustion engine, an operation of the fuel injection period suitable for the initial starting while the detecting circuit detects that the starting is initial starting, an operation of the fuel injection period suitable for the restarting while the detecting circuit detects that the starting is restarting and an operation of the fuel injection period suitable for a steady operation of the internal combustion engine after completion of the starting based on various control conditions. Further, the fuel injection system includes an injector driving current feed control circuit for feeding the fuel injector with the driving current during the fuel injection period provided by the injection command signal.

In a preferred embodiment of the present invention, the initial starting/restarting detecting circuit comprises an ignition confirmation means for confirming ignition of the internal combustion engine during starting of the internal combustion engine, a charge storage circuit including the charge storage element and functioning to charge the charge storage element while ignition of the internal combustion engine is confirmed by the ignition confirmation means, a discharge circuit for causing the charge storage element to discharge charges stored therein at a substantially increased time constant when the internal combustion engine is stopped, and a signal generating circuit for generating, during starting of the internal combustion engine, an initial starting signal while the charge storage element is kept from being charged with a predetermined amount of charges and a restarting signal while the charge storage element is kept charged with the predetermined amount of charges. The microcomputer judges based on the initial starting signal and restarting signal whether starting of the internal combustion engine is the initial starting or the restarting.

In a preferred embodiment of the present invention, the ignition confirmation means is constructed so as to detect a rapid increase in engine rotation speed due to ignition of the internal combustion engine, to thereby confirm ignition of the internal combustion engine.

In a preferred embodiment of the present invention, the charge storage element comprises a capacitor. Also, the charge storage circuit includes a semiconductor switch kept turned on while ignition of the internal combustion engine is confirmed by the ignition confirmation means, to thereby permit the capacitor to be fed with a charging current while using the generator as a power supply therefor.

In a preferred embodiment of the present invention, the fuel injection system may further comprise a switching signal generation means for generating a switching signal when the microcomputer fails to operate or is encountered with any operational abnormality, a command signal generating circuit for generating a low-speed operation injection command signal and a steady operation injection command signal separately from the microcomputer, a selecting circuit for manually or automatically selecting the low-speed operation injection command signal and steady operation injection command signal, a switching circuit for feeding the injector driving current feed control circuit with the injection command signal selected by the selecting circuit while it is fed with the witching signal and the injection command signal output from the microcomputer while it is kept from being from fed with the switching signal, and a switching signal feed control circuit for permitting the switching signal to be fed to the switching circuit only while the selecting circuit selects the low-speed operation injection command signal.

Also, in accordance with the present invention, a fuel injection system for an internal combustion engine is provided. The fuel injection system includes a generator driven by the internal combustion engine, a fuel injector for ejecting fuel when it is fed with a driving current, an ignition confirmation means for confirming ignition of the internal combustion engine during starting of the internal combustion engine, a charge storage circuit including a charge storage element and charging the charge storage element when ignition of the internal combustion engine is confirmed by the ignition confirmation means, a discharge circuit for causing the charge storage element to discharge charges stored therein at a substantially increased time constant, a signal generating circuit for generating an initial starting signal while the charge storage element is kept from being charged with a predetermined amount of charges and a restarting signal while the charge storage element is charged with the predetermined amount of charges, and a microcomputer for generating an injection command signal containing information on a fuel injection period. The microcomputer operates while using the generator as a power supply therefor and carries out, during starting of the internal combustion engine, an operation of the fuel injection period suitable for the initial starting while the signal generating circuit generates the initial starting signal, an operation of the fuel injection period suitable for the restarting while the signal generating circuit generates the restarting signal and an operation of the fuel injection period suitable for a steady operation of the internal combustion engine after completion of the starting based on various control conditions. The fuel injection system also includes an injector driving current feed control circuit for feeding the fuel injector with the driving current during the fuel injection period provided by the injection command signal.

Further, in accordance with the present invention, a fuel injection system for an internal combustion engine free of a battery serving as a control power supply is provided. The fuel injection system includes a generator driven by the internal combustion engine, a fuel injector for ejecting fuel when it is fed with a driving current while using the generator as a power supply therefor, an ignition confirmation means for detecting a rapid increase in engine rotation speed of the internal combustion engine due to ignition of the internal combustion engine to confirm ignition of the internal combustion engine during starting of the internal combustion engine, a charge storage circuit including a charge storage element and charging the charge storage element while ignition of the internal combustion engine is confirmed by the ignition confirmation means, a discharge circuit for causing the charge storage element to discharge charges stored therein at a substantially increased time constant when the internal combustion engine is stopped, a signal generating circuit for generating, during starting of the internal combustion engine, an initial starting signal while the charge storage element is kept from being charged with a predetermined amount of charges and a restarting signal while the charge storage element is charged with the predetermined amount of charges, and a microcomputer for generating an injection command signal containing information on a fuel injection period. The microcomputer operates while using the generator as a power supply therefor and carries out, during starting of the internal combustion engine, an operation of the fuel injection period suitable for the initial starting while the signal generating circuit generates the initial starting signal, an operation of the fuel injection period suitable for the restarting while the signal generating circuit generates the restarting signal and an operation of the fuel injection period suitable for a steady operation of the internal combustion engine after completion of the starting based on various control conditions. The fuel injection system also includes an injector driving current feed control circuit for feeding the fuel injector with the driving current during the fuel injection period provided by the injection command signal.

In a preferred embodiment of the present invention, the charge storage element comprises a capacitor. Also, the charge storage circuit includes a semiconductor switch kept turned on while ignition of the internal combustion engine is confirmed by the ignition confirmation means, to thereby permit the capacitor to be fed with a charging current while using the generator as a power supply therefor.

In a preferred embodiment of the present invention, the fuel injection system may further comprises a switching signal generation means for generating a switching signal when the microcomputer fails to operate or is encountered with any operational abnormality, a command signal generating circuit for generating a low-speed operation injection command signal and a steady operation injection command signal separately from the microcomputer, a selecting circuit for manually or automatically selecting the low-speed operation injection command signal and steady operation injection command signal, a switching circuit for feeding the injector driving current feed control circuit with the injection command signal selected by the selecting circuit while it is fed with the witching signal and the injection command signal output from the microcomputer while it is kept from being from fed with the switching signal, and a switching signal feed control circuit for permitting the switching signal to be fed to the switching circuit only while the selecting circuit selects the low-speed operation injection command signal.

In a preferred embodiment of the present invention, the command signal generating circuit includes a temperature correcting circuit for correcting a signal width of the low-speed operation injection command signal depending on information on a temperature such as an ambient temperature, a temperature of the engine or the like.

In a preferred embodiment of the present invention, the command signal generating circuit includes a signal correcting circuit for varying a signal width of the steady operation injection command signal depending on a degree of opening of a throttle thereof.

The term "steady operation" used herein in connection with an internal combustion engine means an operation of the engine after starting of the engine or an operation of the engine except the starting, therefore, it includes warming-up and idling as well as a so-called steady operation.

In the fuel injection system of the present invention constructed as described above, the signal generating circuit generates the initial starting signal for initial starting of the internal combustion engine because the charge storage element does not have any charge stored therein. Thus, the microcomputer operates a fuel injection rate suitable for initial starting of the engine, to thereby ensure smooth restarting of the engine.

When the engine is temporarily stopped after the initial starting, followed by restarting, the signal generating circuit generates a restarting signal because a sufficient amount of charge is stored in the charge storage element at the initial starting. Concurrently, the microcomputer operates a fuel injection rate suitable for the restarting, to thereby prevent fuel from being excessively fed to the engine, leading to ensure smooth restarting of the engine.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein:

FIG. 2 is a circuit diagram showing an initial starting and restating detection circuit incorporated in the fuel injection system of FIG. 1;

FIGS. 4A–4D are is a diagrammatic view showing a variation in voltage at each of sections of the circuit of FIG. 2 with time during initial starting of the engine;

FIGS. 5A–5D are is a diagrammatic view showing a variation in voltage at each of sections of the circuit of FIG. 2 with time during initial starting of the engine;

FIG. 6 is a circuit diagram showing a switching circuit incorporated in the fuel injection system shown in FIG. 1;

DETAILED DESCRIPTION OF THE PREFERRED EMBODIMENT

Now, a fuel injection system according to the present invention will be described hereinafter with reference to the accompanying drawings.

Figure 1:
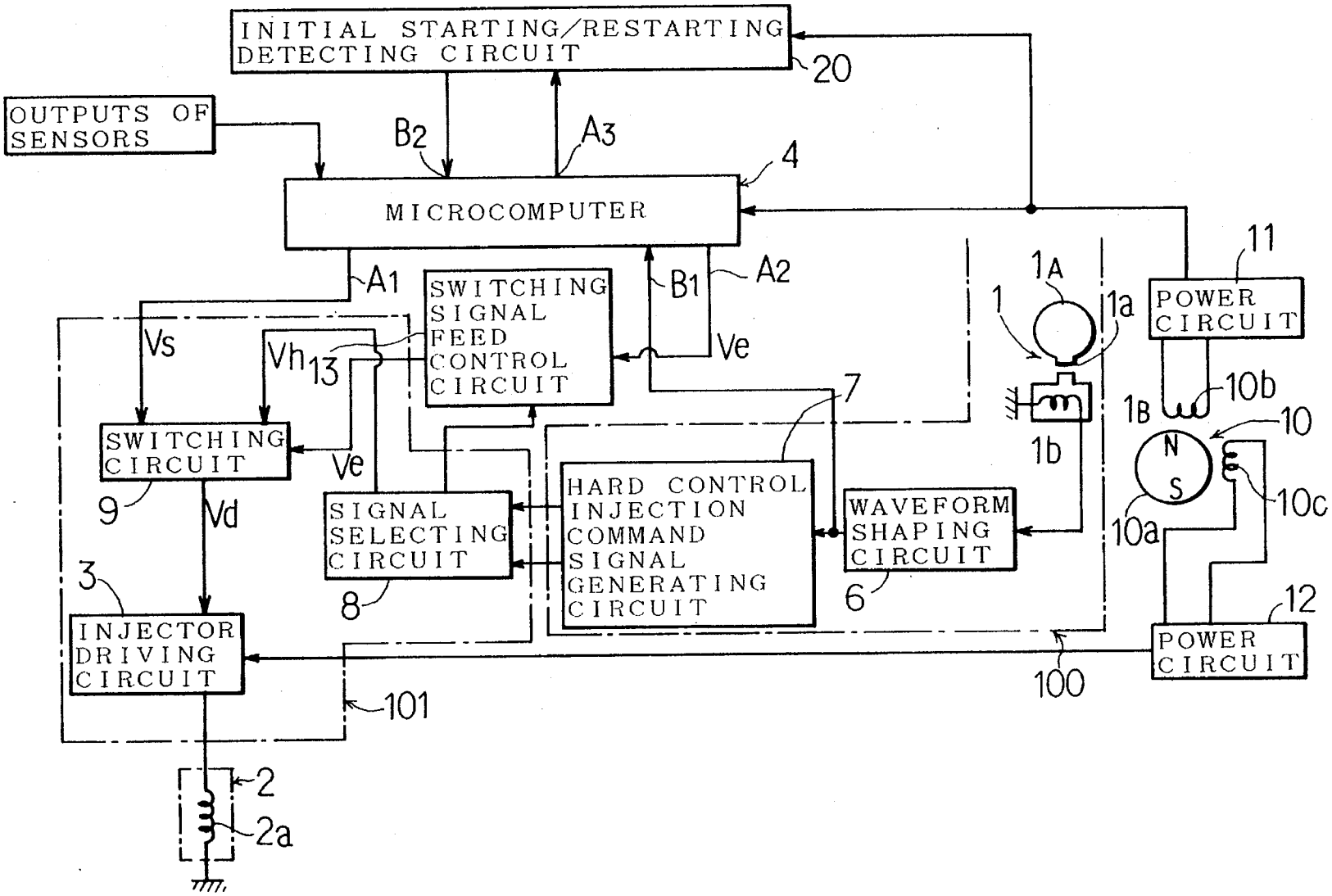
FIG. 1 is a block diagram generally showing an embodiment of a fuel injection system for an internal combustion engine according to the present invention.

Referring first to FIG. 1, an embodiment of a fuel injection system for an internal combustion engine according to the present invention is illustrated. A fuel injection system of the illustrated embodiment includes a signal generator 1 adapted to generate a signal at a predetermined rotation angle position of an internal combustion engine. The signal generator 1 comprises a generator of the inductor type well known in the art which includes a rotor 1A mounted on a revolving shaft of the engine and a signal generating element 1B, wherein the rotor 1A is provided thereon with a reluctor 1*a*. The signal generating element 1B includes a signal coil 1*b* wound on a core having a magnetic pole positioned oppositely to the rotor 1A and a permanent magnet for generating a magnetic flux interlinked to the signal coil, so that the signal coil 1*b* has pulse-like signals different in polarity induced thereacross when the reluctor 1*a* is rendered opposite to the magnetic pole and the reluctor 1*a* is released from the opposition to the magnetic pole of the core, respectively.

Reference numeral 2 designates a fuel injector including a needle valve for operating a nozzle and an electromagnet for operating the needle valve. The fuel injector 2 is fed with fuel under a predetermined pressure from a fuel pump. The fuel injector 2 includes a driving coil 2*a* for exciting the electromagnet, to thereby keep the needle valve open during feeding of a driving current to the driving coil 2*a*, resulting in ejecting fuel therefrom.

Reference numeral 3 designates an injector driving circuit adapted to flow a driving current to the driving coil 2*a* of the fuel injector while a driving signal Vd is kept fed thereto. The driving circuit 3 comprises a switch circuit which is kept closed for a period of time during which it is fed with the driving signal.

4 is a microcomputer, which functions to operate a fuel injection period and a fuel injection position suitable for starting of the engine at the time of starting of the engine based on various control conditions output from various sensors such as a throttle angle, a temperature of the engine and the like, and rotation angle information and speed information each obtained from an output signal of the signal generator, as well as those suitable for steady operation of the engine upon completion of the starting based on the above-described conditions and information. A signal containing information on the fuel injection period and fuel injection position thus obtained by the operation is output in the form of a soft control injection command signal Vs from the microcomputer 4 through an output port A1. The soft control injection command signal Vs thus generated from the microcomputer 4 has, for example, a signal width corresponding to the fuel injection period and a rising position corresponding to the fuel injection position.

Reference numeral 6 is a waveform shaping circuit for converting the output signal of the signal generator 1 into a signal of a rectangular waveform. The signal of a rectangular waveform output from the waveform shaping circuit 6 is fed as a signal for providing the rotation angle information to both an input port B1 of the microcomputer 4 and a hard control injection command signal generating circuit 7.

The hard control injection command signal generating circuit 7 generates a low-speed operation hard control injection command signal Vhi which rises at a fuel injection position in a low-speed operation of the engine in synchronism with the output signal of the signal generator 1 and has a signal width corresponding to the fuel injection period suitable for the low-speed operation of the engine and a steady operation hard control injection command signal Vhn which rises at a fuel injection position in a steady operation of the engine and has a signal width corresponding to the fuel injection period suitable for the steady operation. The signal width of the low-speed operation hard control injection command signal Vhi is set so as to permit the engine to be fed with fuel at a fuel injection rate sufficient to keep rotation of the engine during the low-speed operation of the engine. The fuel injection rate thus provided by the low-speed operation hard control injection command signal Vhi is set at a level equal to a fuel injection rate required for restarting of the engine or less.

The hard control injection command signals Vhi and Vhn are fed through a signal selecting circuit 8 to a switching circuit 9.

In the illustrated embodiment, driving of the microcomputer 4 and injector drive circuit 3 is carried out by means of a magneto 10 mounted on the engine. The magneto 10 includes a magnet rotor 10*a* mounted on the revolving shaft of the engine and a stator including generating coils 10*b* and 10*c*. An output of each of the generating coils 10*b* and 10*c* is fed to power circuits 11 and 12, respectively.

The power circuits 11 and 12 function as D.C. voltage stabilizers for rectifying AC outputs of the generating coils 10*b* and 10*c* to output DC constant voltages, respectively. The DC voltages obtained from the power circuits 11 and 12 are applied to a power terminal of the microcomputer 4 and a power terminal of the injector drive circuit 3, respectively.

The signal selecting circuit 8 functions to select the low-speed operation hard control injection command signal Vhi during the low-speed operation of the internal combustion engine to output a hard control injection command signal Vh and select the steady hard operation control injection command signal Vhn during the steady operation of the engine to likewise output the hard control injection command signal Vh.

The signal selecting circuit 8 may be constructed so as to select the signal by a switch manually operated or by a switch automatically operated when a failure in operation of the microcomputer 4 occurs. Alternatively, the signal selecting circuit 8 may be constructed so as to detect an engine rotation speed, to thereby automatically select the low-speed operation control injection command signal Vhi when the engine rotation speed is below a predetermined level and the steady operation hard control injection command signal Vhn when it exceeds the predetermined level.

The microcomputer 4 also includes an output port A2 and functions to output a switching signal Ve through the output port A2 when a voltage induced across the generating coil 10*b* is established to permit the microcomputer 4 to normally operate and interrupt outputting of the switching signal Ve through the output port A2 when the induction voltage across the generating coil is decreased to a degree sufficient to fail to provide a power voltage for the microcomputer 4, leading to a failure in operation of the microcomputer or when any abnormality occurs in operation of the microcomputer. Any abnormality which occurs in operation of the microcomputer may be detected according to a procedure known in the art in which a program for checking a microcomputer is previously incorporated in a program for actuating the microcomputer. In the illustrated embodiment, a switching signal generating means is realized by a soft ware for actuating the microcomputer 4.

The switching signal Ve described above is fed through a switching signal feed control circuit 13 to the switching circuit 9. The switching signal feed control circuit 13 serves to permit the switching signal Ve to be fed to the switching circuit 9 during a period of time for which the signal selecting circuit 8 selects the low-speed operation hard control injection command signal Vhi and prohibit the switching signal Ve from being fed to the switching circuit 9 while the signal selecting circuit 8 selects the steady operation hard control injection command signal Vhn. The switching signal feed control circuit 13 may comprise a switch actuated in association with a selecting operation of the signal selecting circuit 8 in a manner to be closed when the signal selecting circuit 8 selects the low-speed operation hard control injection command signal Vhi and open when it selects the steady operation hard control injection command signal Vhn.

The switching circuit 9 feeds the injector drive circuit 3 with a signal of the same waveform as the hard control injection command signal Vh output from the signal selecting circuit 8 in the form of the drive signal Vd while it is kept from being fed with the switching signal Ve and feeds it with a signal of the same waveform as the soft control injection command signal Vs output from the microcomputer 4 as the drive signal Vd while it is kept fed with the switching signal Ve.

The fuel injection system of the illustrated embodiment includes an initial starting/restarting detecting circuit 20, which may be constructed in such a manner as shown in FIG. 2. In FIG. 2, reference character 21*a* designates a charge storage element comprising a capacitor 21*a*, which is grounded at one end thereof and connected at the other end thereof through a resistor 21*b* to a cathode of a diode 21*c*. An anode of the diode 21*c* is connected to a collector of a PNP transistor 21*d*, of which an emitter is connected to an output terminal of the power circuit 11. The transistor 21*d* is connected at a base thereof through a resistor 21*e* to an output port A3 of the microcomputer 4. Also, the initial starting/restarting detecting circuit 20 includes a resistor 21*f* connected between the base of the transistor 21*d* and the emitter thereof and a resistor 22*a* of a large resistance connected across the charge storage element 21*a*.

The capacitor 21*a* acting as the charge storage element is connected at a non-grounded terminal thereof to a gate of a field effect transistor (FET) 23*a*, of which a drain is connected to an input port B2 of the microcomputer 4, as well as through a resistor 23*b* to an output terminal of the power circuit 11.

The microcomputer 4 realizes an ignition confirmation means for confirming ignition (explosion) of the internal combustion engine. More specifically, the microcomputer 4 is adapted to causes a potential at the output port A3 to be zero or decreased to a low level when it confirms ignition of the engine at the time of starting of the engine, to thereby output a ignition confirmation signal.

In view of the fact that an engine rotation speed is instantaneously rapidly increased when ignition of the engine is carried out at the time of starting of the engine, the ignition confirmation means described above may be realized by a means for measuring an interval at which the signal coil 1*b* generates the output signal, to thereby measure an instantaneous engine speed and a means for outputting the ignition confirmation signal when an excess of the instantaneous engine speed over a predetermined value is detected.

In the illustrated embodiment, the charge storage element 21*a*, transistor 21*d*, resistors 21*b*, 21*e* and 21*f*, and diode 21*c* cooperates with each other to form a charge storage circuit 21 which permits charges to be accumulated or stored in the charge storage element 21*a* when ignition of the engine is confirmed by the ignition confirmation means. Also, the resistor 22*a* constitutes a discharge circuit 22 for permitting charges stored in the charge storage element 21*a* to be discharged over a sufficiently increased length of time and the field effect transistor 23*a* and resistor 23*b* cooperate together to constitute an initial starting/restarting signal generating circuit 23.

The initial starting/restarting signal generating circuit 23 is constructed so as to permit the field effect transistor 23*a* to be turned on to render a potential at the input terminal B2 of the microcomputer substantially zero, to thereby generate a restarting signal which is a signal of which a level is zero or low, when charged are stored in a predetermined amount in the charge storage element 21*a*. When charges stored in the charge storage element 21*a* fail to reach the predetermined amount, the field effect transistor 23*a* is kept turned off to keep the potential at the input port B2 of the microcomputer at a high level, resulting in an initial starting signal being generated.

The microcomputer 4 functions to confirm the potential at the input port B2 when starting control of the engine is to be carried out, resulting in executing an operation of the fuel injection period suitable for initial starting of the engine when the potential at the input port B2 is at a high level, as well as an operation of the fuel injection period suitable for restarting of the engine when the potential at the input port B2 is at a zero level or low level or when the restarting signal is generated.

In the illustrated embodiment, the signal generator 1, waveform shaping circuit 6 and hard control injection command signal generating circuit 7 cooperate with each other to constitute a hard control injection command signal generating circuit 100 which is provided separate from the microcomputer 4 and functions to generate the low-speed operation hard control injection command signal Vhi containing information on the fuel injection period suitable for the low-speed operation of the engine during the low-speed operation and generate the steady operation hard control injection command signal Vhn containing information on the fuel injection period suitable for the steady operation of the engine during the steady operation.

Further, the signal selecting circuit 8, switching circuit 9 and injector driving circuit 3 cooperate with each other to provide an injector driving current feed control circuit 101 which functions to feed the fuel injector 2 with a driving current during a period of time for which the fuel injection period provided by the soft control injection command signal Vs continues when the microcomputer 4 is permitted to carry out a normal operation and feed the fuel injector 2 with the driving current during a period of time for which the fuel injection period provided by the hard control injection command signal Vh output from the hard control injection command signal generating circuit 100 continues when the microcomputer 4 is not permitted to carry out the normal operation.

The hard control injection command signal Vh and soft control injection command signal Vs each are merely required to contain information on the fuel injection period predetermined, therefore, the signals each are not necessarily required to be a signal of a rectangular waveform. For example, each of the signals may comprise a pair of pulse signals containing a pulse signal generated at a fuel injection start position and a pulse signal generated at a fuel injection termination position. Also, the injection command signals may take any form depending on a structure of the injector driving circuit 3.

The soft control injection command signal Vs and hard control injection command signal Vh may have the same waveform or different waveforms. For example, the soft control injection command signal Vs may comprise a signal of a rectangular waveform which rises at the fuel injection position and has a signal width corresponding to the fuel injection period, whereas the hard control injection command signal Vh may comprise a pulse signal obtained by subjecting each of signals Vp1 and Vp2 generated from the signal generator 1 to waveform shaping. When the illustrated embodiment is so constructed that the pulse signal obtained by waveform shaping of each of the signals Vp1 and Vp2 is fed to the injector driving circuit 3 to flow the driving current through the fuel injector 2, the fuel injector 2 is caused to intermittently eject fuel. However, such intermittent injection of fuel by the fuel injector 2 does not adversely affect an operation of the engine.

In the embodiment illustrated in FIG. 1, the signal generator 1 for providing the microcomputer with the rotation angle information acts also as a signal generator for providing the hard control injection command signal Vh. Alternatively, the embodiment may be so constructed that such a signal generator for providing the hard control injection command signal may be arranged separate from the signal generator 1 for providing the microcomputer with the rotation angle information, resulting in an output signal of the signal generator thus separately arranged being subject to waveform shaping and then fed to the hard control injection command signal generating circuit 7 to provide the hard control injection command signal Vh (Vhi and Vhn).

For the sake of brevity, in the illustrated embodiment, it is contemplated that the soft control injection command signal Vs and hard control injection command signal Vh are formed into a rectangular waveform which rises at the fuel injection position and has a signal width corresponding to the fuel injection period.

Also, the drive signal Vd is merely required to indicate that a driving current is flowed from the injector driving circuit 3 to the fuel injector 2 during the fuel injection period provided by the injection command signals Vh and Vs, therefore, it is not necessarily required that the injection command signals Vh and Vs have the same waveform. The drive signal Vd may be shaped into a suitable waveform depending on a construction of the injector driving circuit 3. In the illustrated embodiment, the injection command signals Vh and Vs each are shaped into the same waveform as the drive signal Vd.

Figure 3:
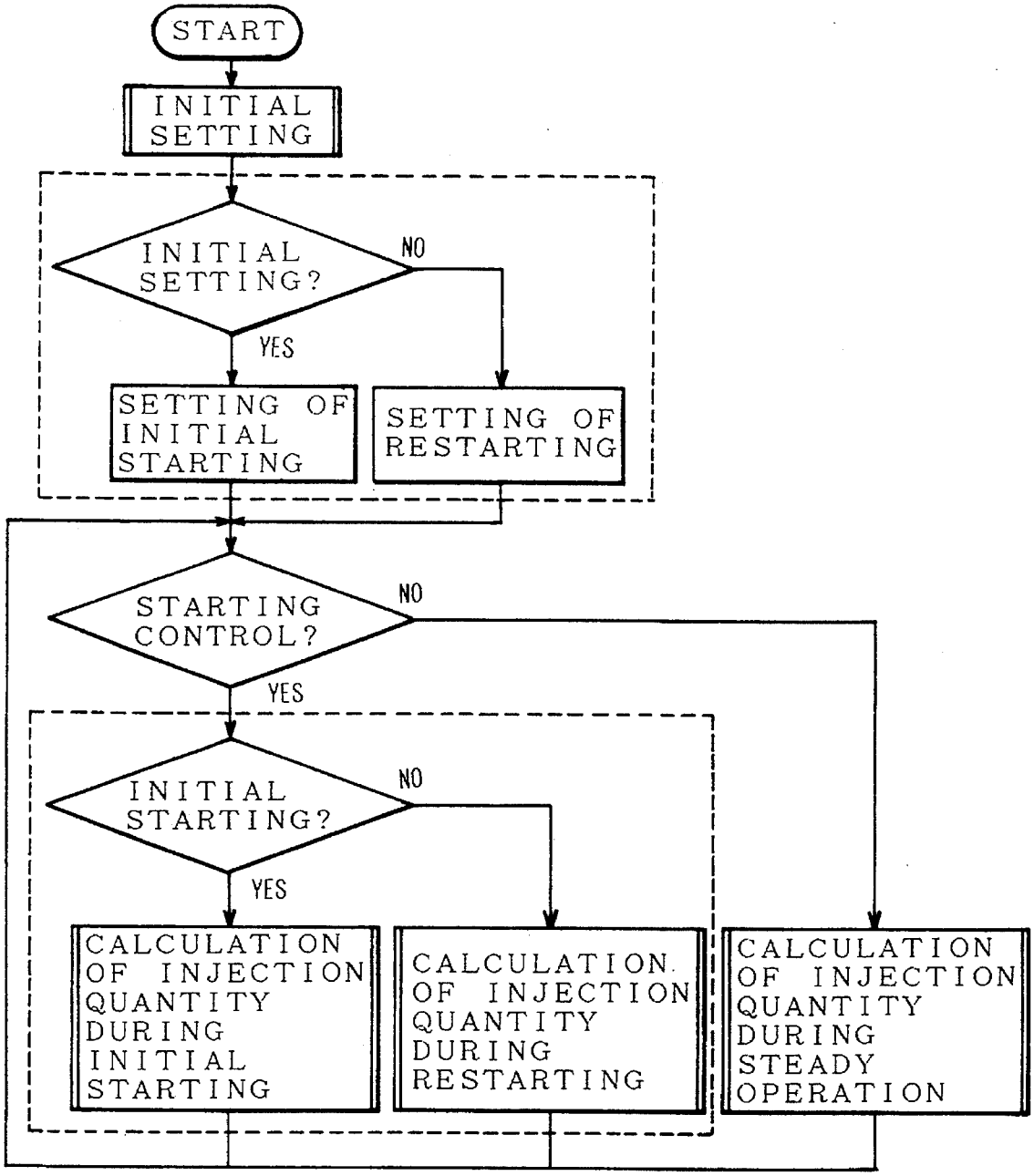
FIG. 3 is a flow chart showing a control algorithm in the fuel injection system shown in FIG. 1.

FIG. 3 shows algorithm of control of the fuel injection system of the illustrated embodiment by the microcomputer 4. Now, the manner of operation of the fuel injection system carried out according to the control algorithm shown in FIG. 3 will be described hereinafter.

When a voltage of the generator 10 is established during initial starting of the engine, the microcomputer 4 starts its operation, resulting in initial setting of each of sections of the fuel injection system first taking place. After the initial setting, the microcomputer 4 confirms a voltage at the input port B2 of the microcomputer 4 to judge whether starting of the engine is initial starting or restarting. Thus, when it is confirmed that the potential is at a zero level or a low level, therefore, the starting is judged to be initial starting, the microcomputer reads data for initial starting from a ROM, leading to setting of initial starting. Then, it judges whether starting control of the engine should be executed or not, so that when it is confirmed that the starting control should be carried out, the microcomputer judges again in view of the potential at the input port B2 whether the starting is initial starting or restarting. When this results in the initial starting being confirmed, the microcomputer 4 carries out an operation of a fuel injection period and an injection position suitable for the initial starting by means of data read therein to generate an injection command signal containing information on the fuel injection period and injection position thus obtained by the operation.

As a result of confirmation of the potential at the input port B2 of the computer 4 after the initial setting as described above, when it is confirmed that the potential is at a high level and the starting is restarting, the microcomputer then reads data for the restarting from the ROM to set the restarting. Then, the microcomputer judges whether the starting control should be executed or not or whether starting of the engine is completed or not; and, as a result, when it is confirmed that the starting control should be carried out, the microcomputer judges again whether the starting of the engine is initial starting or restarting. When it is confirmed that the starting is restarting, the microcomputer carries out an operation of a fuel injection period and an injection position suitable for the restarting based on the data read therein, to thereby generate an injection command signal containing information on the fuel injection period and injection position thus obtained by the operation.

As a result that the microcomputer 4 judges whether the starting control should be carried out or not, when it is confirmed that steady control of the engine should be executed because starting of the engine has been already completed, the microcomputer carries out an operation of a fuel injection period and an injection position suitable for a steady operation of the engine under various conditions, to thereby generate an injection command signal containing information on the fuel injection period and injection position thus obtained by the operation.

Judgment on whether the starting control should be carried out or not may be executed, for example, by counting an engine rotation speed. More specifically, detection of the engine rotation speed may be carried out by counting a period of time between generation of a certain signal from the signal generator 1 and that of the next signal.

Now, the manner of operation of the fuel injection system of the illustrated embodiment constructed as shown in FIGS. 1 and 2 will be described hereinafter with reference to FIGS. 4(A) to 4(D) and FIGS. 5(A) to 5(D).

FIGS. 4(A) to 4(D) each show a variation in each of an output voltage V1 of the power circuit 11, a voltage V2 at the output port A3 of the microcomputer 4, a voltage V3 across the charge storage element 21*a* and a voltage V4 at the input port B2 of the microcomputer 4 with time, respectively. FIGS. 5(A) to 5(D) show variations in voltage V1 to V4 during restarting of the engine with time, respectively.

When a start unit is started at the time of initial starting of the engine to rotate the engine at time t1, a voltage is induced across the generating coil 10*b* to cause the output voltage V1 of the power circuit 11 to be increased as shown in FIG. 4(A). Such an increase in voltage V1 leads to an increase in potential at each of the output port A3 and input port B2 of the microcomputer 4. Also, rotation of the engine likewise causes a voltage to be induced across the generating coil 10*c*, leading to an increase in output of the power circuit 12. It is not required that a voltage required to cause a current of a required level to flow the fuel injector 2 is not increased to a substantial degree, therefore, the injector driving circuit 3 is allowed to satisfactorily operate immediately after a starting operation of the engine.

An operation of the microcomputer is not permitted until the output voltage V1 of the power circuit 11 is increased to a level of a voltage V10 necessary to operate the microcomputer 4, so that generation of the switching signal Ve by the microcomputer 4 is suspended. Therefore, the switching circuit 9 causes the hard control injection command signal Vh output from the signal selecting circuit 8 to be fed as the driving signal Vd to the injector drive circuit 3. Thus, the injector driving circuit 3 causes a driving current to flow through the driving coil 2*a* of the fuel injector 2 during a period of time for which it is kept fed with the drive signal Vd.

Then, when the voltage induced across the generating coil 10*b* is established to permit a power voltage $E_O$ of a predetermined level to be applied from the power circuit 11 to the microcomputer 4, it is permitted to output the switching signal Ve through the output port A2 of the microcomputer. The switching signal Ve thus output is then fed through the switching signal feed control circuit 13 to the switching circuit 9, so that the switching circuit 9 feeds the soft control injection command signal Vs fed from the microcomputer 4 thereto to the injector driving circuit 3 as the drive signal Vd. This results in the injector driving circuit 3 being allowed to feed the driving coil 2*a* of the fuel injector 2 with a driving current during a period of time for which it is fed with the driving signal Vd, so that the fuel injector 2 may inject fuel.

Where starting of the engine is not carried out at the time when the microcomputer starts to operate, starting control of the engine is executed. When ignition of the engine is not yet carried out during initial starting of the engine, any charge is not yet stored in the charge storage element 21*a*. Therefore, the field effect transistor 23*a* is kept turned off, so that the potential V4 at the input port B2 of the microcomputer 4 is kept at a high level. At this time, the microcomputer 4 generates an injection command signal providing the fuel injection period and injection position suitable for initial starting of the engine.

When ignition of the engine is detected at time t3 after the microcomputer 4 starts to operate, the potential V2 at the output port A3 of the microcomputer 4 is decreased as shown in FIG. 4(B), so that the transistor 21*d* shown in FIG. 2 is turned on to permit charges to be moved from the power circuit 11 through the transistor 21*d*, diode 21*c* and resistor 21*b* to the charge storage element 21*a*, resulting in being stored in the element 21*a*. This leads to an increase in voltage V3 across the charge storage element 21*a* as shown in FIG. 4(C). Then, when the voltage V3 is increased to a level Ef which permits the field effect transistor 23*a* to be turned on at time t4, it is turned on to cause the potential V4 at the input port B2 of the microcomputer 4 to be substantially zero, resulting in a restart signal being generated. Thereafter, so long as the voltage V3 across the charge storage element 21*a* is kept above the level Ef, the potential V4 at the input port B2 is kept zero or the restart signal is kept generated. When an operation for stopping the engine is carried out at time t5 to stop an ignition operation of the engine, an engine rotation speed is decreased to cause the voltage of the generating coil 10*b* and therefore the output voltage V1 of the power circuit 11 to be decreased. When the engine is stopped at time t6, the voltage V1 of the power circuit 11 is rendered zero. However, the resistor 22*a* which causes charges in the charge storage element 21*a* to be discharged therefrom has a resistance sufficient to permit discharge from the charge storage element 21*a* to be slowly or gradually carried out over a long period of time, so that the field effect transistor 23*a* may be kept turned on in a predetermined length of time after stoppage of the engine, resulting in the restarting signal being kept generated.

When restarting of the engine is carried out at time t1' as shown in FIG. 5(A), the potential V4 at the input port B2 is rendered zero to cause the restarting signal to be generated at the time when the voltage of the generator 10 is established at time t2' to permit the microcomputer 4 to start to operate. This results in the microcomputer 4 generating the injection command signal Vs providing the fuel injection period and injection position suitable for restarting of the engine.

When at the time of restarting of the engine, the hard control injection command signal Vh causes the engine to be started before the microcomputer 4 starts its operation, the microcomputer 4 proceeds to steady control immediately after the operation is started, so that it carries out an operation of the fuel injection period suitable for steady operation of the engine to generate the injection command signal Vs containing information on the fuel injection period obtained by the operation.

When the microcomputer 4 fails to carry out its normal operation during a steady operation of the engine or, for example, malfunction of the microcomputer causes runaway of the engine, the signal selecting circuit 8 is caused to select the steady operation hard control injection command signal Vhn to feed it as the hard control injection command signal Vh to the switching circuit 9. Concurrently, the switching signal feed control circuit 13 prohibits the switching signal Ve from being fed to the switching circuit 9, so that the switching circuit 9 feeds the injector drive circuit 3 with the hard control injection command signal Vh acting as the driving signal Vd.

The illustrated embodiment may be constructed in such a manner that a program for checking the operation of the microcomputer 4 is incorporated in a program for operating the microcomputer, to thereby permit the microcomputer to stop generation of the switching signal when any abnormality occurs in the operation of the microcomputer. Such construction eliminates arrangement of the switching signal feed control circuit 13.

When the engine is to be started while the microcomputer 4 is out of order, the signal selecting circuit 8 is first caused to select the low-speed operation hard control injection command signal Vhi to start the engine and then the signal selecting circuit 8 is caused to select the steady operation hard control injection command signal Vhn upon starting of the engine. Changing-over from selection of the low-speed operation hard control injection command signal Vhi to selection of the steady operation hard control injection command signal Vhn is preferably carried out automatically when, for example, the engine rotation speed detected exceeds a predetermined level.

FIG. 6 shows an example of the switching circuit 9 incorporated in the illustrated embodiment, which is constructed so as to permit a transistor TR1 to be turned on while it is fed with the switching signal Ve, leading to short-circuiting of the hard control injection command signal Vh. Concurrently, the transistor TR2 is turned on to keep the transistor TR3 turned on or interrupted, to thereby permit the soft control injection command signal Vs to be input to an OR circuit OR. Thus, the soft control injection command signal Vs is fed through the OR circuit OR to the injector drive circuit 3 so as to serve as the driving signal Vd while the switching signal Ve is fed.

When the switching signal Ve is kept from being fed with the switching circuit, the transistor TR2 is turned off or interrupted and the transistor TR3 is turned on, leading to short-circuiting of the soft control injection command signal Vs, resulting in the command signal Vs being prevented from being fed to the OR circuit OR. Concurrently, the transistor TR1 is kept interrupted, so that the hard control injection command signal Vh may be fed through the OR circuit OR to the injector driving circuit 3 so as to serve as the driving signal Vd.

Figure 7:
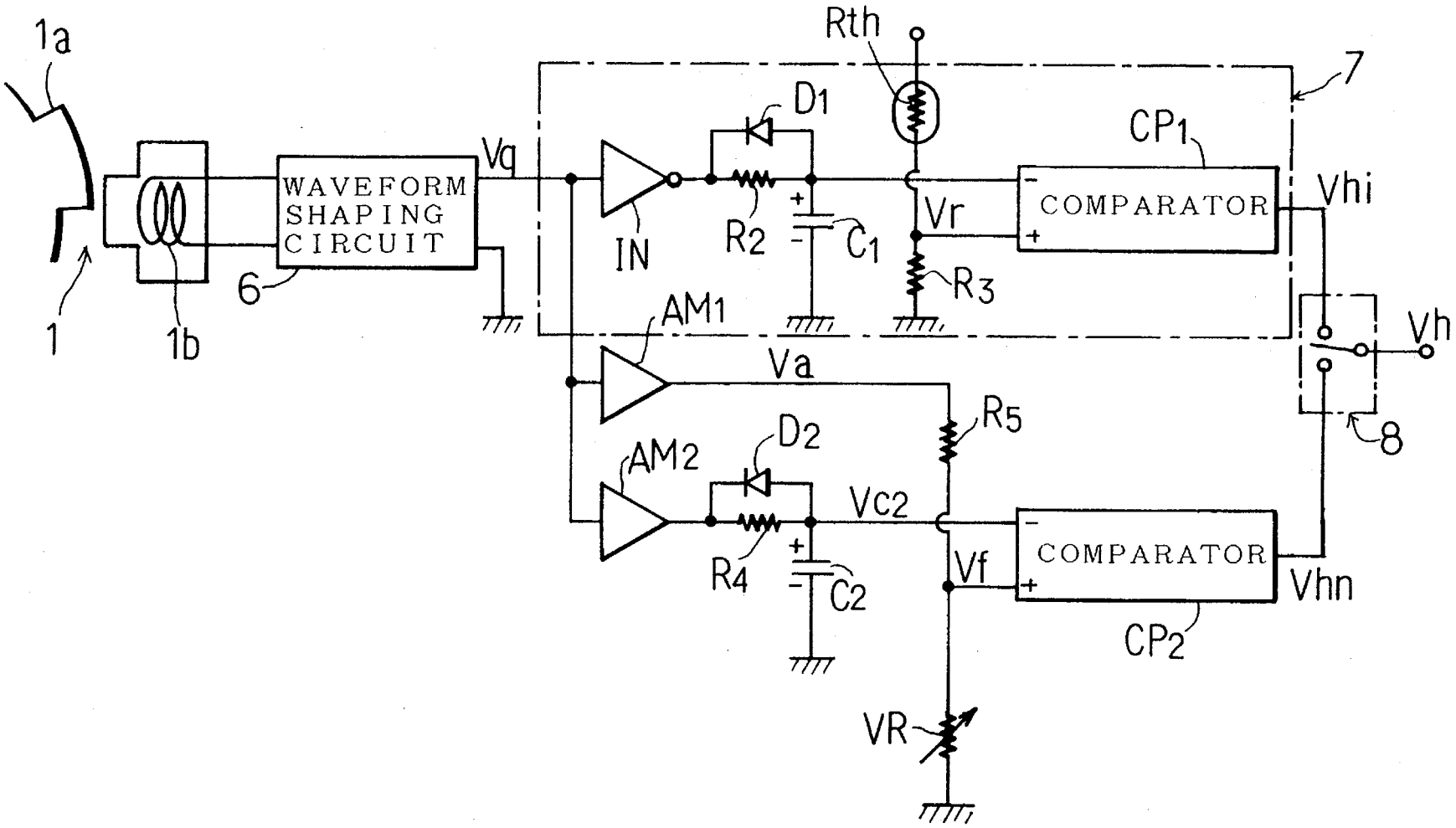
FIG. 7 is a circuit diagram showing an essential part of the fuel injection system of FIG. 1.
Figures 8A, 8B, 8C, 8D, 8E, 8F, 8G, 8H, 8I, 8J:
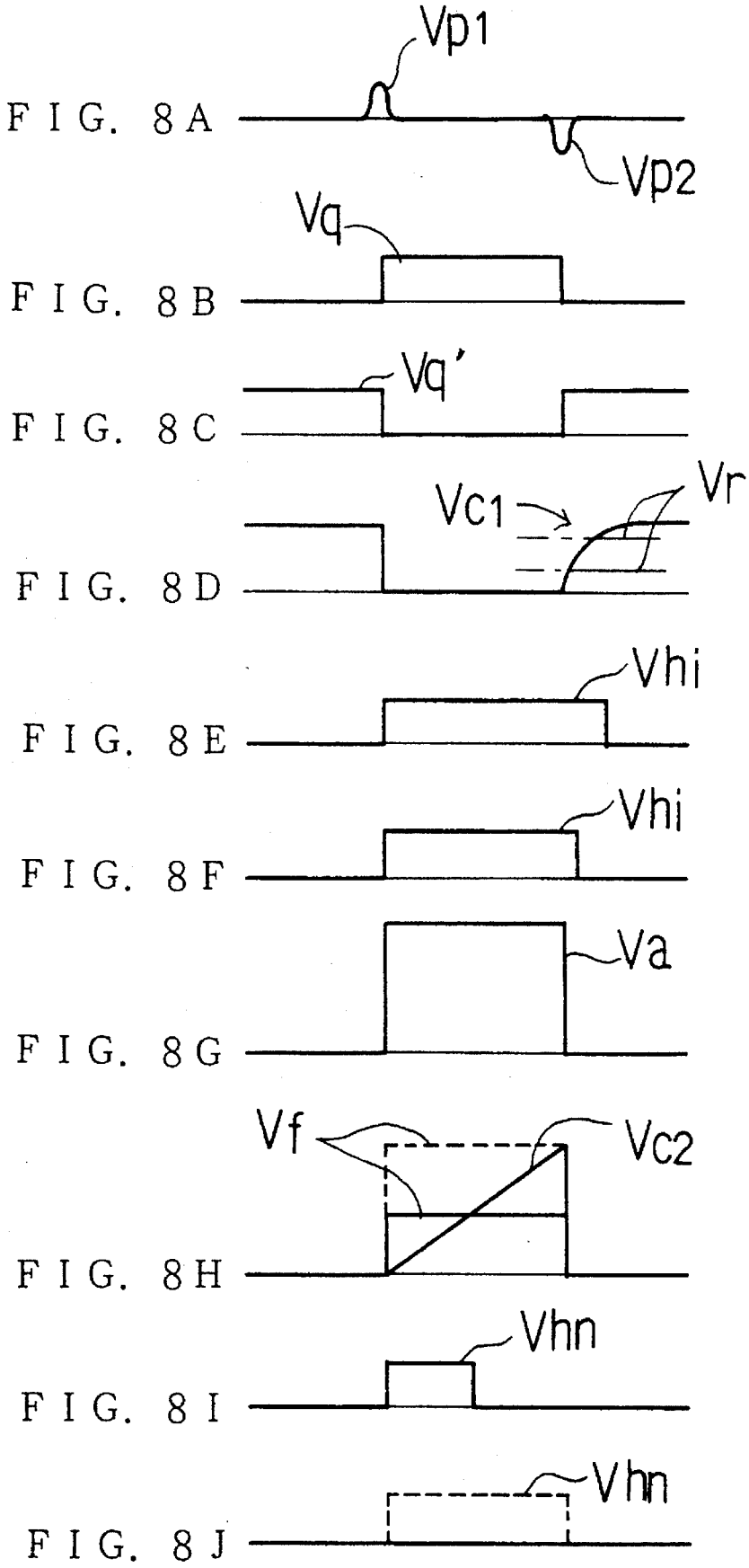
FIGS. 8(A) to 8(J) each are a waveform chart showing a signal waveform at each of sections of the fuel injection system shown in FIG. 7.

FIG. 7 shows an example of construction of the signal generator. 1, waveform shaping circuit 6, hard control injection command signal generating circuit 7 and signal selecting circuit 8. The signal generator 1 is constructed so as to generate the pulse signals Vp1 and Vp2 different in polarity one time at every one rotation of the engine in synchronism with rotation of the engine as shown in FIG. 8(A). A positional relationship between the rotor 1A of the signal generator 1 and the signal generating element 1B thereof is so set that the signal Vp1 initially generated reaches a threshold level at the fuel injection position of the engine.

The waveform shaping circuit 6 may comprise, for example, a flip-flop circuit set and reset by the signals Vp1 and Vp2, respectively, and is adapted to generate a signal Vq of a rectangular waveform having a signal width corresponding to a length of time necessary for the pulse signal Vp2 to reach the threshold level after the pulse signal Vp1 reaches the threshold level, as shown in FIG. 8(B). The signal Vq is then inverted by an inverter IN, so that an output signal Vq' (FIG. 8C) of the inverter permits the capacitor C1 to be charged through the resistor R2. Charges in the capacitor C1 are instantaneously discharged through a diode D1 and a ground circuit (not shown) of the inverter IN when the output of the inverter IN is zero or at a ground level. A voltage Vc1 across the capacitor C1 has such a waveform as shown in FIG. 8(D) and is input to an inversion input terminal of the comparator CP1.

In order to detect an ambient atmosphere and a temperature at each of sections of the engine, the hard control injection command signal generating circuit 7 is provided with a temperature sensor comprising a positive thermo-sensitive resistor element Rth, and a series circuit comprising the thermo-sensitive resistor element Rth and a resistor R3 is connected across a DC power supply (not shown), so that a reference voltage Vr obtained across the resistor R3 is input to a non-inversion input terminal of the comparator CP1. The comparator CP1 generates the low-speed operation hard control injection command signal Vhi of a rectangular waveform kept at a high level during a period of time for which the reference voltage Vr exceeds the terminal voltage Vc1 of the capacitor C1. The reference voltage Vr is increased when a temperature of the engine is low to cause a resistance of the thermo-sensitive resistor element Rth to be decreased and decreased when the temperature is increased to lead to an increase in resistance of the thermo-sensitive resistor element Rth. Therefore, the low-speed operation hard control injection command signal Vhi obtained when an ambient temperature and a temperature of the engine are low has a waveform of which a signal width is increased as shown in FIG. 8(E), whereas that obtained when the engine temperature is high has a waveform of which a signal width is reduced as shown in FIG. 8(F).

The output Vq of the waveform shaping circuit 6 is also applied through an amplifier AM1 across a series circuit comprising a resistor R5 and a variable resistor Vr constituting a throttle sensor. A signal Va of a rectangular waveform (FIG. 8G) obtained on an output side of the amplifier AM1 is subject to voltage dividing through a diving circuit comprising the resistor R5 and the variable resistor Vr, resulting in a reference signal Vf being obtained across the variable resistor VR. An increase in degree of opening of a throttle detected by the throttle sensor causes an increase in resistance of the variable resistor, so that the reference signal Vf is increased in crest value as indicated at broken lines in FIG. 8(H). A decrease in degree of opening of the throttle leads to a decrease in resistance of the variable resistor VR, so that the reference signal Vf is reduced in crest value as indicated at solid lines in FIG. 8(H). The crest value of the reference signal Vf is varied in a manner to be substantially proportional to a degree of opening of the throttle. The reference signal Vf is input to the inversion input terminal of the comparator CP2.

The output Vq of the waveform shaping circuit 6 is also amplified by an amplifier AM2, of which an output causes a capacitor C2 to be charged through the resistor R4. As shown in FIG. 8(H), a voltage Vc2 across the capacitor C2 is linearly increased with lapse of time. When the rectangular-waveform signal Vq is rendered zero, charges in the capacitor C2 are instantaneously discharged through a diode D2. The voltage Vc2 across the capacitor C2 is input to the non-inversion input terminal of the comparator CP2.

The comparator CP2 generates the steady operation hard control injection command signal Vhn of a rectangular waveform kept at a high level while the reference signal Vf exceeds a voltage Vc2 across the capacitor C2. The command signal Vhn is decreased and increased in signal width as shown in FIGS. 8(I) and 8(J) when a degree of opening of the throttle is reduced and increased, respectively.

In the construction shown in FIG. 7, the inverter In, resistors R2 and R3, capacitor C1, thermo-sensitive resistor element Rth, and comparator CP1 cooperate with each other to constitute a temperature correcting circuit for varying information on the fuel injection period provided by the low-speed operation hard control injection command signal Vhi depending on temperature data such as an ambient atmosphere, a temperature of the engine and the like. Also, the amplifiers AM1 and AM2, resistors R4 and R5, diode D2, variable resistor VR, and comparator CP2 constitute a signal width correcting circuit for varying a signal width of the steady operation hard control injection command signal Vhn depending on a degree of opening of the throttle.

As in the construction shown in FIG. 7, a variation in information on the fuel injection period provided by the low-speed operation control injection command signal Vhi depending on the temperature data increases the fuel injection period when an ambient temperature and a temperature of the engine are low, to thereby facilitate starting of the engine. Also, a variation in signal width of the steady operation hard control injection command signal Vhn depending on a degree of opening of the throttle permits the fuel injection period to be set in an amount corresponding to the degree during the hard control, to thereby ensure stable operation of the engine, resulting in an output of the engine being satisfactorily utilized.

In the illustrated embodiment, a signal width of the steady operation hard injection command signal Vhn is varied depending on a degree of opening of the throttle. Alternatively, it may be varied depending on other control conditions.

The signal selecting circuit 8 shown in FIG. 7 comprises a changing-over switch, resulting in selecting any one of the low-speed operation control injection command signal Vhi and steady operation hard control injection command signal Vhn to feed it as the hard control injection command signal to the switching circuit 9. The changing-over switch constituting the signal selecting circuit 8 may be a manually operated switch. Alternatively, it may comprise an electrically controlled switch such as a relay, a semiconductor switch or the like.

In the construction shown in FIG. 7, the single circuit is used for varying a signal width of each of the low-speed operation hard control injection command signal Vhi and steady operation control injection command signal Vhn. Alternatively, a plurality of rectangular-waveform signal generating circuits may be arranged for generating signals of a rectangular waveform different in signal width in synchronism with the pulse signal Vp1 generated from the signal generator 1, so that outputs of the rectangular-waveform signal generating circuits are selectively output depending on a magnitude of each of the control conditions such as a temperature of the engine, a degree of opening of the throttle and the like.

The illustrated embodiment is so constructed that the microcomputer 4 generates the switching signal Ve. Alternatively, the present invention may be constructed in such a manner that a voltage detecting circuit is arranged for detecting a power voltage of the microcomputer 4, resulting in a hard circuit generating the switching signal Ve when the voltage detected by the voltage detecting circuit is above a minimum value required for normally operating the microcomputer 4.

Further, the illustrated embodiment may be constructed in such a manner that a circuit utilizing a suitable means such as a means for monitoring a variation in engine rotation speed or the like is provided for discriminating whether an operation of the microcomputer is normal or abnormal, resulting in generating the switching signal Ve when the operation of the microcomputer is abnormal.

The illustrated embodiment, as described above, is so constructed that the microcomputer 4 carries out an operation of each of the fuel injection position and fuel injection period. Alternatively, the microcomputer 4 may operate only the fuel injection period and the fuel injection position may be determined by a timing signal generated from the signal generator 1.

Also, in the illustrated embodiment, when the microcomputer 4 fails to normally operate, the fuel injector 2 is driven by means of the hard control injection command signal Vh provided by the signal generator 1 and electronic circuit 7. However, the present invention is not limited to use of the hard control injection command signal Vh. For example, the present invention may be widely applicable to a fuel injection system wherein a fuel injector is controlled by means of a microcomputer driven by an output of a generator driven by an internal combustion engine.

As can be seen from the foregoing, the fuel injection system of the present invention includes the initial starting/restarting signal generating circuit for generating the initial starting signal during initial starting of the engine and the restarting signal during restarting of the engine, so that fuel may be injected into the engine at a fuel injection rate suitable for the initial starting in the case that the initial starting signal is kept generated at the time when the microcomputer starts to operate and at a fuel injection rate suitable for the restarting in the case that the restarting signal is kept generated at that time. Thus, the present invention effectively prevents fuel from being excessively fed to the engine during the restarting, to thereby ensure smooth restarting of the engine.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise as specifically described.

What is claimed is:

1. A fuel injection system for an internal combustion engine, comprising:

a generator driven by the internal combustion engine;

a fuel injector for ejecting fuel when it is fed with a driving current while using said generator as a power supply therefor;

an initial starting/restarting detecting circuit including a charge storage element charged by means of an output of said generator and discharging charges stored therein during stoppage of the internal combustion engine;

said initial starting/restarting detecting circuit detecting depending on the amount of charges stored in said charge storage element whether starting of the internal combustion engine is initial starting or restarting while starting of the internal combustion engine is carried out;

a microcomputer for generating an injection command signal containing information on a fuel injection period;

said microcomputer operating while using said generator as a power supply therefor;

said microcomputer carrying out, during starting of the internal combustion engine, an operation of the fuel injection period suitable for the initial starting while said detecting circuit detects that the starting is initial starting, an operation of the fuel injection period suitable for the restarting while said detecting circuit detects that the starting is restarting and an operation of the fuel injection period suitable for a steady operation of the internal combustion engine after completion of the starting based on various control conditions; and an injector driving current feed control circuit for feeding said fuel injector with said driving current during said fuel injection period provided by said injection command signal.

2. A fuel injection system as defined in claim 1, wherein said initial starting/restarting detecting circuit comprises:

an ignition confirmation means for confirming ignition of the internal combustion engine during starting of the internal combustion engine;

a charge storage circuit including said charge storage element and functioning to charge said charge storage element while ignition of the internal combustion engine is confirmed by said ignition confirmation means;

a discharge circuit for causing said charge storage element to discharge charges stored therein at a substantially increased time constant when the internal combustion engine is stopped; and a signal generating circuit for generating, during starting of the internal combustion engine, an initial starting signal while said charge storage element is not charged with a predetermined amount of charges and a restarting signal while said charge storage element is charged with the predetermined amount of charges; and said microcomputer judges based on said initial starting signal and restarting signal whether starting of the internal combustion engine is said initial starting or said restarting.

3. A fuel injection system as defined in claim 2, wherein said ignition confirmation means is constructed so as to detect a predetermined increase in engine rotation speed due to ignition of the internal combustion engine, to thereby confirm ignition of the internal combustion engine.

4. A fuel injection system as defined in claim 2, wherein said charge storage element comprises a capacitor; and said charge storage circuit includes a semiconductor switch kept turned on while ignition of the internal combustion engine is confirmed by said ignition confirmation means, to thereby permit said capacitor to be fed with a charging current while using said generator as a power supply therefor.

5. A fuel injection system as defined in claim 1, further comprising a switching signal generation means for generating a switching signal when said microcomputer fails to operate or is encountered with any operational abnormality;

a command signal generating circuit for generating a low-speed operation injection command signal and a steady operation injection command signal separately from said microcomputer;

a selecting circuit for manually or automatically selecting said low-speed operation injection command signal and steady operation injection command signal;

a switching circuit for feeding said injector driving current feed control circuit with said injection command signal selected by said selecting circuit while it is fed with said switching signal and said injection command signal output from said microcomputer while it is kept from being fed with said switching signal; and a switching signal feed control circuit for permitting said switching signal to be fed to said switching circuit only while said selecting circuit selects said low-speed operation injection command signal.

6. A fuel injection system for an internal combustion engine, comprising:

a generator driven by the internal combustion engine;

a fuel injector for ejecting fuel when it is fed with a driving current;

an ignition confirmation means for confirming ignition of the internal combustion engine during starting of the internal combustion engine;

a charge storage circuit including a charge storage element and charging said charge storage element when ignition of said internal combustion engine is confirmed by said ignition confirmation means;

a discharge circuit for causing said charge storage element to discharge charges stored therein at a substantially increased time constant;

a signal generating circuit for generating an initial starting signal while said charge storage element is not charged with a predetermined amount of charges and a restarting signal while said charge storage element is charged with the predetermined amount of charges;

a microcomputer for generating an injection command signal containing information on a fuel injection period;

said microcomputer operating while using said generator as a power supply therefor;

said microcomputer carrying out, during starting of the internal combustion engine, an operation of the fuel injection period suitable for the initial starting while said signal generating circuit generates said initial starting signal, an operation of the fuel injection period suitable for the restarting while said signal generating circuit generates said restarting signal and an operation of the fuel injection period suitable for a steady operation of the internal combustion engine after completion of the starting based on various control conditions; and an injector driving current feed control circuit for feeding said fuel injector with said driving current during said fuel injection period provided by said injection command signal.

7. A fuel injection system for an internal combustion engine free of a battery serving as a control power supply, comprising:

a generator driven by the internal combustion engine;

a fuel injector for ejecting fuel when it is fed with a driving current while using said generator as a power supply therefor;

an ignition confirmation means for detecting a predetermined increase in engine rotation speed of the internal combustion engine due to ignition of the internal combustion engine to confirm ignition of the internal combustion engine during starting of the internal combustion engine;

a charge storage circuit including a charge storage element and charging said charge storage element while ignition of the internal combustion engine is confirmed by said ignition confirmation means;

a discharge circuit for causing said charge storage element to discharge charges stored therein at a substantially increased time constant when the internal combustion engine is stopped;

a signal generating circuit for generating, during starting of the internal combustion engine, an initial starting signal while said charge storage element is not charged with a predetermined amount of charges and a restarting signal while said charge storage element is charged with the predetermined amount of charges;

a microcomputer for generating an injection command signal containing information on a fuel injection period;

said microcomputer operating while using said generator as a power supply therefor;

said microcomputer carrying out, during starting of the internal combustion engine, an operation of the fuel injection period suitable for the initial starting while said signal generating circuit generates said initial starting signal, an operation of the fuel injection period suitable for the restarting while said signal generating circuit generates said restarting signal and an operation of the fuel injection period suitable for a steady operation of the internal combustion engine after completion of the starting based on various control conditions; and an injector driving current feed control circuit for feeding said fuel injector with said driving current during said fuel injection period provided by said injection command signal.

8. A fuel injection system as defined in claim 7, wherein said charge storage element comprises a capacitor; and said charge storage circuit includes a semiconductor switch kept turned on while ignition of the internal combustion engine is confirmed by said ignition confirmation means, to thereby permit said capacitor to be fed with a charging current while using said generator as a power supply therefor.

9. A fuel injection system as defined in claim 7, further comprising a switching signal generation means for generating a switching signal when said microcomputer fails to operate or is encountered with any operational abnormality;

a command signal generating circuit for generating a low-speed operation injection command signal and a steady operation injection command signal separately from said microcomputer;

a selecting circuit for manually or automatically selecting said low-speed operation injection command signal and steady operation injection command signal;

a switching circuit for feeding said injector driving current feed control circuit with said injection command signal selected by said selecting circuit while it is fed with said switching signal and said injection command signal output from said microcomputer while it is kept from being fed with said switching signal; and a switching signal feed control circuit for permitting said switching signal to be fed to said switching circuit only while said selecting circuit selects said low-speed operation injection command signal.

10. A fuel injection system as defined in claim 9, wherein said command signal generating circuit includes a temperature correcting circuit for correcting a signal width of the low-speed operation injection command signal depending on information on a temperature such as an ambient temperature, a temperature of the engine.

11. A fuel injection system as defined in claim 9, wherein said command signal generating circuit includes a signal correcting circuit for varying a signal width of said steady operation injection command signal depending on a degree of opening of a throttle detected by a throttle sensor.

* * * * *